US006276078B1

(12) United States Patent
Beverly et al.

(10) Patent No.: US 6,276,078 B1
(45) **Date of Patent: *Aug. 21, 2001**

(54) STREAM IRON TOP COVER AND METHOD OF MANUFACTURE

(75) Inventors: S. Devon Beverly, Midlothian; Martin Brady, Chesterfield, both of VA (US)

(73) Assignee: Hamilton Beach/Proctor-Silex, Inc., Glen Allen, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 5 days.

(21) Appl. No.: 09/388,841

(22) Filed: Sep. 1, 1999

(51) Int. Cl.[7] ..... D06F 75/34
(52) U.S. Cl. ..... 38/90
(58) Field of Search ..... 38/88, 90, 91, 38/92; 219/250, 256

(56) References Cited

U.S. PATENT DOCUMENTS 4,646,451 * 3/1987 Nakao et al. ..... 38/90 X
4,745,260 * 5/1988 Albinger, Jr. et al. ..... 219/250
5,390,433 * 2/1995 Brady ..... 38/88 X
5,619,812 * 4/1997 Hensel et al. ..... 38/88
5,799,421 * 9/1998 Bouleau ..... 38/88
5,844,203 12/1998 Chasen et al. .

* cited by examiner

*Primary Examiner*—Ismael Izaguirre
(74) *Attorney, Agent, or Firm*—Roger S. Dybvig

(57) ABSTRACT

A steam iron having an electronic module with a reset switch in the upper portions of the iron handle covered by a top cover. The top cover includes a plastic body having a reset plate formed integrally therewith and partly surrounded by an opening in the top cover. A pliant overmold covers a portion of the plastic body and extends through the opening to confine the top and bottom of the reset plate, restricting movements of the plate but permitting limited movements thereof. During manufacture of the steam iron, a boss at the rearward end of the top cover is inserted into a bearing on the handle and spring fingers at the forward end of the handle are pushed downwardly along sloping surfaces of a circular flange on the handle, the spring fingers snapping outwardly when they reach the bottom of the circular flange to secure the top cover to the handle.

4 Claims, 3 Drawing Sheets

30
26
24
58
60
48
52
62
50
66
56
10
22
64
18
20
36
34
28
38
21
40
46
44
42
16
32
35
12
14

FIG-3
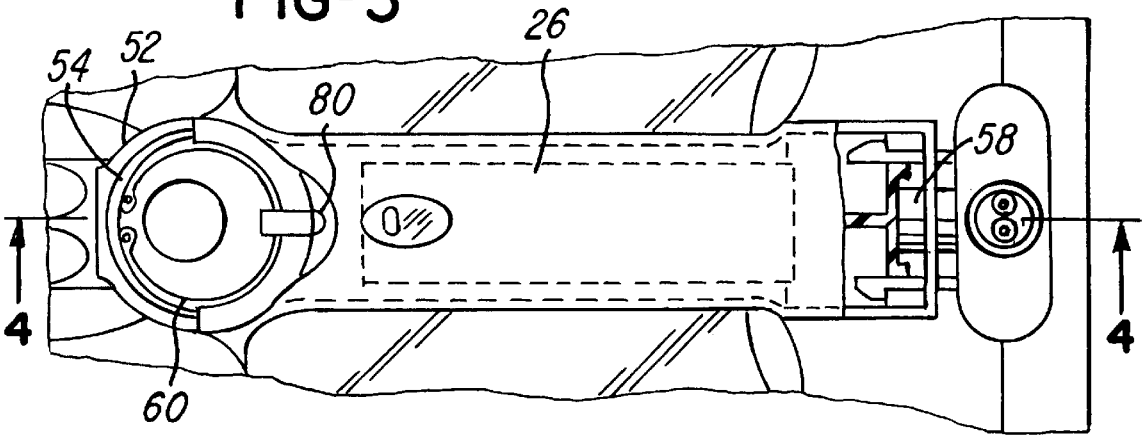
FIG-4
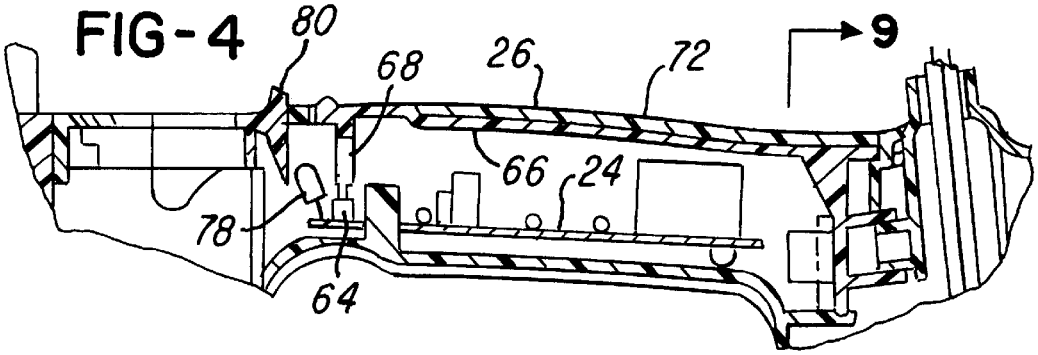
FIG-5
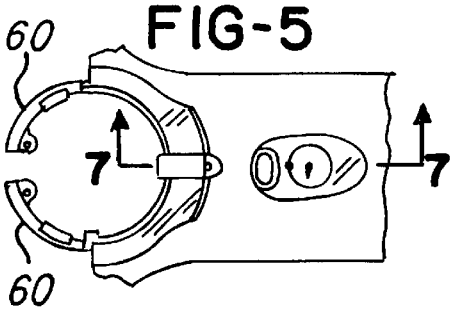
FIG-7
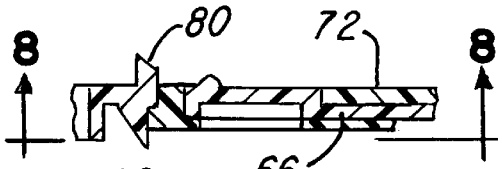
FIG-6
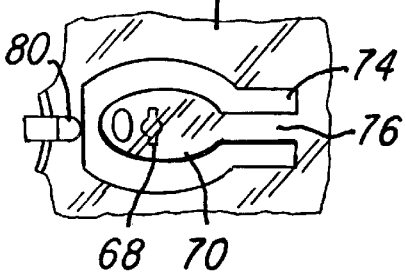
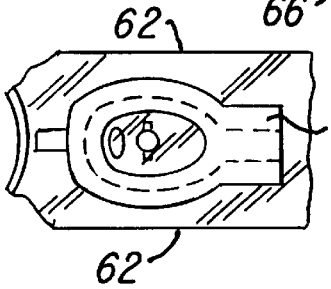
FIG-8
FIG-9
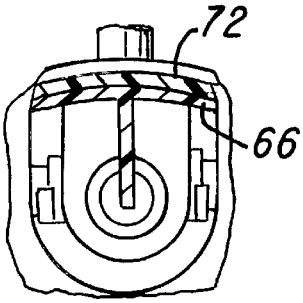

STREAM IRON TOP COVER AND METHOD OF MANUFACTURE

FIELD OF THE INVENTION

This invention relates to a steam iron and a method and apparatus for assembling a steam iron top cover onto a handle and for providing a reset switch operator for a steam iron.

BACKGROUND AND SUMMARY OF THE INVENTION

Modern electronic steam irons are often provided with electronic modules in the upper portions of the iron handle which are covered by a top cover. This invention provides a novel top cover, which may include a reset button for actuating a reset switch forming part of an electronic control module, and a method of assembling the top cover onto a handle.

Other objects, advantages and features of this invention will become apparent from the following description and the drawings.

BRIEF DESCRIPTION OF THE DRAWINGS

FIG. 3 is a fragmentary plan view of a portion of the steam iron of FIG. 1.

FIG. 4 is a cross-sectional view taken on line 4—4 of FIG. 3.

FIG. 5 is a fragmentary plan view of the front end of a top cover in accordance with this invention.

FIG. 6 is a fragmentary plan view of a portion of a substrate that forms part of the top cover.

FIG. 7 is fragmentary cross-sectional view of a portion of the top cover taken on lines 7—7 of FIG. 5.

FIG. 8 is a bottom plan view of a portion of the top cover and taken along line 8—8 of FIG. 7.

FIG. 9 is a fragmentary cross-sectional view taken on line 9—9 of FIG. 4.

DETAILED DESCRIPTION

Figure 1:
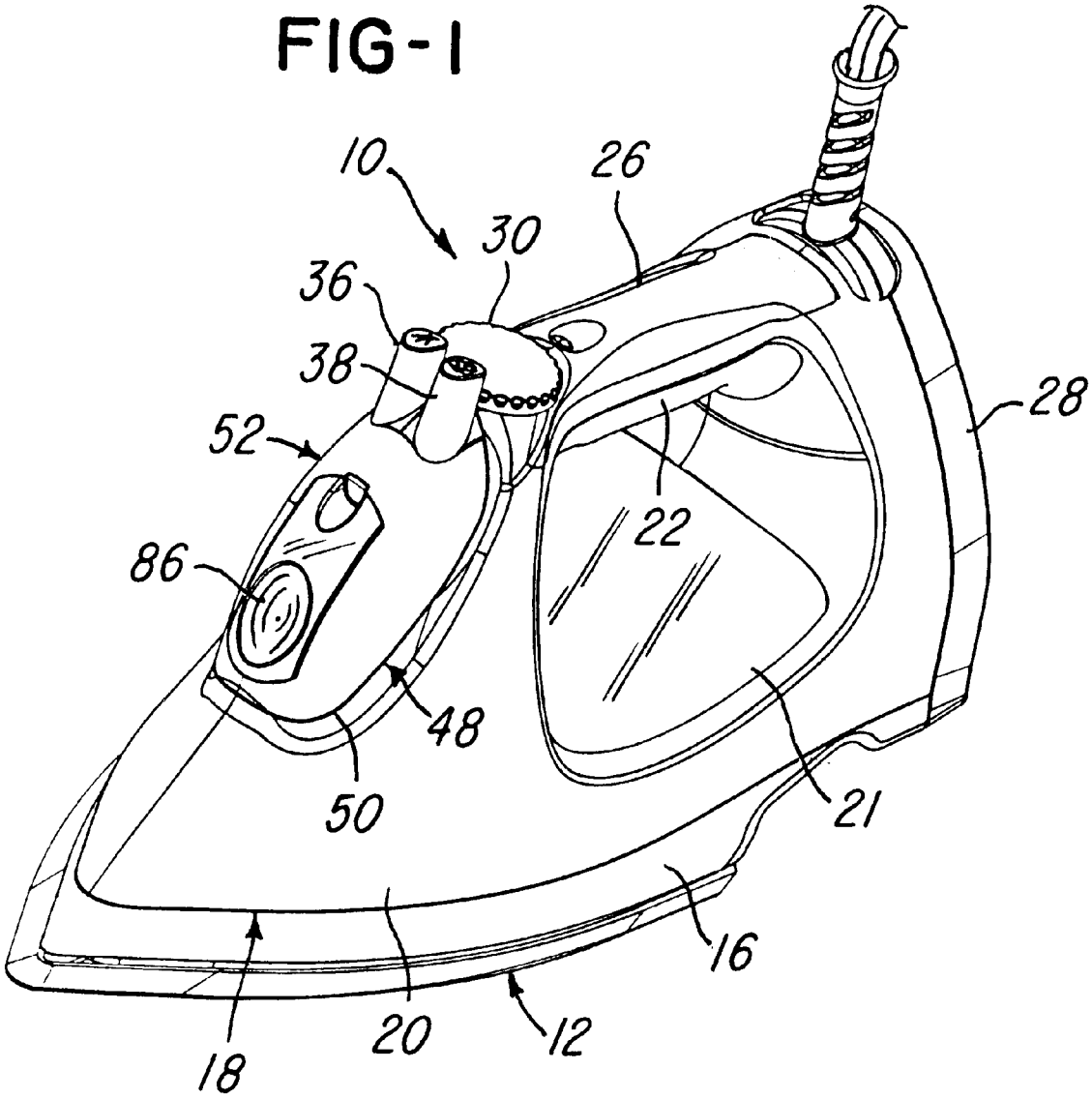
FIG. 1 is a perspective view of a steam iron that has a fill port assembly made in accordance with this invention.
Figure 2:
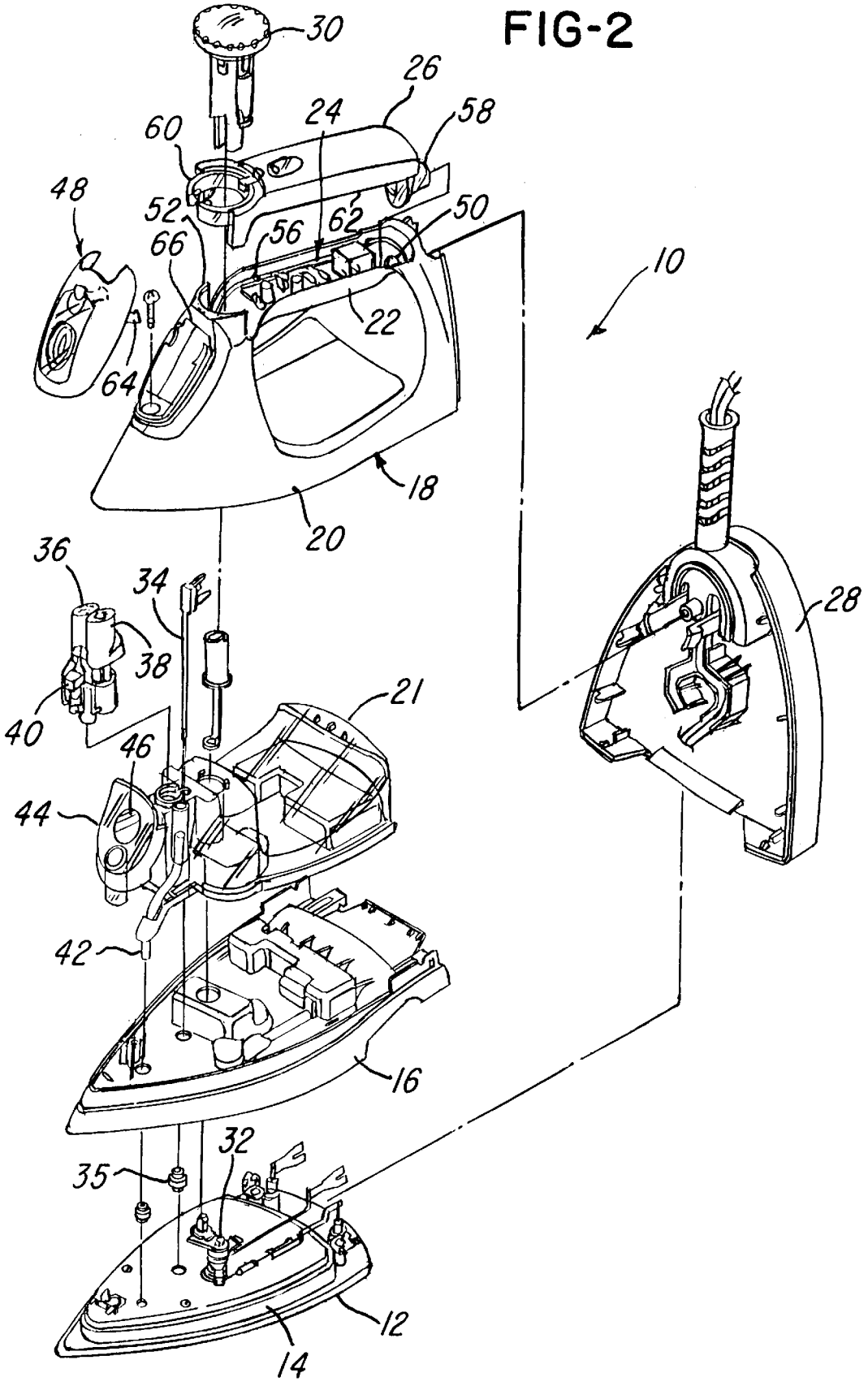
FIG. 2 is an exploded isometric view of the iron of FIG. 1.

With reference to FIGS. 1 and 2, the present invention is illustrated in connection with a household steam iron, generally designated 10, having a soleplate 12 with a steam chamber 14, covered by a base cover 16 which supports a handle 18. Handle 18 has a lower portion 20 which confines a water reservoir 21 and an upper portion 22 which receives an electronic control module 24 and which is covered by a top cover 26. The handle upper portion 22 and the top cover 26 constitute a handgrip. In addition, the iron 10 includes a rear cover 28, a temperature control knob 30 for setting a thermostat 32 mounted on the soleplate 12, and a drip valve assembly including a drip valve stem 34 for dripping controlled quantities of water into the steam chamber 14 through a drip valve seal 35. As well known, the water dripped into the steam chamber 14 is heated by an electrical heating element in the soleplate 12, vaporizes and forms steam which exits from the soleplate 12 through plural steam vents (not shown). The heating element and the electronic controls are connected to house current by means of a power cord connected to the rear cover 28. The particular iron 10 shown in the drawings also has a pair of manually-operable pistons 36 and 38, respectively used to spray water forwardly of the iron through a nozzle 40 and to create a burst of steam by pumping water by way of a thermoplastic tube connection 42 into the steam chamber 14.

The water reservoir 21 has a forwardly projecting, concave front face 44 and a water conduit 46 extending from the front face 44 into the hollow interior of the reservoir 21. A fill port assembly, generally designated 48, is used in association with the water conduit 46 for pouring water into the water reservoir 21.

With reference to FIGS. 2 through 5, a bearing 50 centered about a horizontal axis is provided at the rearward end of the handle 18 and a semicircular flange 52 is provided on said handle spaced forwardly and generally in confronting relation to said bearing. The flange 52 has an upwardly-facing, generally parabolic cam surface 54. In addition the handle 18 has a pair of upwardly facing shoulders 56 extending in the length direction of the steam iron 10 between the bearing 50 and the flange 52.

The top cover 26 has a rearwardly-extending boss 58 at its rearward end adapted to be received by the bearing and, at its opposite or forward end, has a pair of mutually-confronting circular spring arms 60. Downwardly facing edges 62 between its forward and rearward ends are adapted to be supported by the upwardly facing shoulders 56 of the handle 18.

To assemble the top cover 26 onto the handle 18, the boss 58 is inserted into the bearing 50 and the top cover 26 pivoted so that its edges 62 are aligned with the handle's shoulders 56 and so that the spring arms 60 engage the upwardly-facing cam surface 54 of the flange 52.

By moving the forward end of the top cover 26 downwardly, the spring arms 60 slide downwardly along the cam surface 54 on the flange 52 until they are located below the bottom of the flange 52 and snap outwardly to extend beneath the flange 52.

The cam surface 54 is shaped so that its central, forwardmost end portion has the greatest slope and its rearward, side edges have the least slope. With this construction, the spring arms 60 are squeezed toward one another as the front end of the top cover 26 is moved downwardly during assembly onto the handle.

The electronic control module 24 includes a reset switch 64. The top cover comprises a substantially rigid plastic body 66 having a generally U-shaped opening 74 partly surrounding a plate 70 at the end of an elongate lever 76 formed integrally with the plastic body 66. A depending reset pin 68 integrally molded to the bottom of the plate 70 is adapted to engage and operate the reset switch 64. A pliant overmold 72, which could be made from Santoprene, covers a portion of the plastic body 66 and extends through the U-shaped opening 74. Accordingly, the overmold 72 body confines both the top and the bottom surfaces of the plate 70 and the lever 72 to restrict the movements thereof but permit limited movements thereof.

The reset pin 68 also acts as a light tube for transmitting light from an LED 78 to the plate 70 to indicate that the iron is energized. Another light path is provided by a rod 80 which can serve as the indicator to which temperature settings may be adjusted by the temperature control knob 30.

Although the presently preferred embodiment of this invention has been described, it will be understood that within the purview of the invention various changes may be made within the scope of the following claims.

Having thus described our invention, we claim:

1. A method of assembling a top cover of a steam iron to the upper portion of a steam iron handle, said method comprising the steps of:

providing a bearing at the rearward end of the handle centered about a horizontal axis;

providing a semicircular flange on said handle spaced forwardly of and generally in confronting relation to said bearing, said flange having an upwardly facing cam surface;

providing a pair of upwardly facing shoulders on said handle extending in the length direction of the steam iron between said bearing and said flange;

providing a top cover having a rearwardly-extending boss at its rearward end adapted to be received by said bearing and having a pair of mutually-confronting circular spring arms at its forward end and downwardly facing edges between said forward end and said rearward end;

inserting said boss into said bearing and pivoting said top cover so that said edges of said top cover are aligned with said shoulders on said handle and so that said spring arms engage the cam surface of said flange; and moving the forward end of said top cover downwardly so that said spring arms slide downwardly along said flange until they are located below the bottom of said flange and snap outwardly to extend beneath said flange.

2. A top cover for a steam iron that covers an electronic control module that includes a reset switch, said top cover comprising a substantially rigid plastic body, having a generally U-shaped opening partly surrounding a plate at the end of an elongate lever formed integrally with said plastic body, a depending reset pin integrally molded to the bottom of said plate, and a pliant overmold covering a portion of said plastic body and extending through said U-shaped opening and confining both the top and the bottom surfaces of said said lever including said plate to restrict the movements thereof but permit limited movements thereof.

3. A method of assembling a top cover of a steam iron to the upper portion of a steam iron handle, said method comprising the steps of:

providing a bearing at the rearward end of the handle;

providing a semicircular flange on said handle spaced forwardly of said bearing, said flange having an upwardly facing cam surface;

providing a top cover having a rearwardly-extending boss at its rearward end adapted to be received by said bearing and having a pair of mutually-confronting spring arms at its forward end;

inserting said boss into said bearing and pivoting said top cover and so that said spring arms engage the cam surface of said flange; and moving the forward end of said top cover downwardly so that said spring arms slide downwardly along said flange until they are located below the bottom of said flange and snap outwardly to extend beneath said flange.

4. A steam iron comprising:

a handle having a bearing at its rearward end and a semicircular flange at its forward end, said flange having a rearwardly-facing cam surface;

a top cover for covering the upper portion of said handle, said top cover having a rearwardly-extending boss received in said bearing and a pair of mutually-confronting circular spring arms at its forward end and shaped so that, during assembly of the top cover onto the handle, said spring arms slide down said cam surface and, upon final assembly of said top cover onto said handle, said spring arm snap outwardly under mutually spaced portions of said flange.

* * * * *